US011466406B2

(12) United States Patent
Huang et al.

(10) Patent No.: US 11,466,406 B2
(45) Date of Patent: Oct. 11, 2022

(54) CELLULOSE-SILICON OXIDE COMPOSITE SUPERHYDROPHOBIC MATERIAL AND PREPARATION METHOD THEREOF

(71) Applicant: Guangxi University, Nanning (CN)

(72) Inventors: Chongxing Huang, Nanjing (CN); Yuan Zhao, Nanning (CN); Hui Zhao, Nanning (CN); Lijie Huang, Nanning (CN); Yangfan Xu, Nanning (CN); Qingshan Duan, Nanning (CN); Cuicui Li, Nanning (CN); Hongxia Su, Nanning (CN); Jian Wang, Nanning (CN); Linyun Zhang, Nanning (CN)

(73) Assignee: GUANGXI UNIVERSITY, Nanning (CN)

( * ) Notice: Subject to any disclaimer, the term of this patent is extended or adjusted under 35 U.S.C. 154(b) by 0 days.

(21) Appl. No.: 17/116,573

(22) Filed: Dec. 9, 2020

(65) Prior Publication Data

US 2021/0180255 A1 Jun. 17, 2021

(30) Foreign Application Priority Data

Dec. 13, 2019 (CN) ..... 201911284737.X

(51) Int. Cl.

| | |
|---|---|
| ***D21H 19/14*** | (2006.01) |
| ***D21H 11/12*** | (2006.01) |
| ***D21H 19/82*** | (2006.01) |
| ***D21H 21/16*** | (2006.01) |
| ***D21H 25/04*** | (2006.01) |

(52) U.S. Cl.

CPC ..... *D21H 19/14* (2013.01); *D21H 11/12* (2013.01); *D21H 19/824* (2013.01); *D21H 21/16* (2013.01); *D21H 25/04* (2013.01)

(58) Field of Classification Search

CPC ..... D21H 19/824; D21H 19/14; D21H 21/16; D21H 19/32; D21H 19/82; D21H 11/12; D21H 25/04

USPC ..... 162/136

See application file for complete search history.

(56) References Cited

U.S. PATENT DOCUMENTS

2010/0197102 A1* 8/2010 Akao ..... H01L 21/02664 438/303

FOREIGN PATENT DOCUMENTS

WO WO 2016/018144 * 2/2016 ..... C23C 18/12

* cited by examiner

*Primary Examiner* — Mark Halpern

(74) *Attorney, Agent, or Firm* — Troutman Pepper Hamilton Sanders LLP (Rochester)

(57) ABSTRACT

A cellulose-silicon oxide composite superhydrophobic material and a preparation method thereof are disclosed. In the method, cellulose substrates with different surface topographies are pretreated by a low-temperature plasma, and then a first silicon oxide layer is deposited on the cellulose substrate by a low-temperature plasma-enhanced chemical vapor deposition method, then modified by a low-temperature plasma, and finally a second silicon oxide layer is deposited thereon, thereby preparing a micro-nano structured superhydrophobic surface on the cellulose substrate, to obtain a cellulose-silicon oxide composite superhydrophobic material, which is an environmentally friendly bio-based hydrophobic material.

6 Claims, 4 Drawing Sheets

CELLULOSE-SILICON OXIDE COMPOSITE SUPERHYDROPHOBIC MATERIAL AND PREPARATION METHOD THEREOF

This application claims the benefit of Chinese Patent Application Serial No. 201911284737.X, filed Dec. 13, 2019, which is hereby incorporated by reference in its entirety.

FIELD

The present disclosure relates to the technical field of superhydrophobic materials, and particularly to a cellulose-silicon oxide ($SiO_x$) composite superhydrophobic material and a preparation method thereof.

BACKGROUND

Hydrophobic materials have a special surface wettability, and have larger contact angle(s) and smaller sliding angle(s) towards the water, tea, juice, carbonated beverages, and other liquids. In particular, superhydrophobic materials often have functions, such as waterproofing, anti-icing, anti-fouling, self-cleaning, or fluid drag reduction, and can be widely used in surface protection, medical equipment, display screens, textiles, and product packaging.

Cellulose is the most abundant natural polymer material in nature. It is non-toxic, harmless, environmentally friendly, and has good processability, mechanical properties, biocompatibility and degradability, and thus it is a very potential substitute for petrochemical products. However, pure cellulose materials have relatively high permeability, relatively strong water vapor, oxygen, carbon dioxide and nitrogen permeability, and they are easy to absorb moisture and oil, and have poor impact resistance and thermal stability. Therefore, with the global environmental protection trends, the hydrophobic modification of cellulose substrates to obtain superhydrophobic materials can not only alleviate resource conflicts, but also can make cellulose become the first choice for environmentally friendly bio-based materials. As the "new force" of sustainable biomass materials, it has a huge market space.

According to the biomimetic theory, there are two main ways to achieve super-hydrophobic surface properties: one is to modify the surface of conventional substrates with substances with relatively low surface energy, such as fluorocarbons, organosilicons, hydrocarbon compounds, and metal oxides such as zinc oxide and titanium dioxide; the other is to construct a rough micro-nano structure on the surface of the low-surface-energy substrate. According to these principles, the current common preparation technologies and processes of superhydrophobic materials mainly include lithography, plasma etching, micro-nano additive manufacturing, coating, template, self-assembly, deposition, electrospinning, nanoimprinting, and casting technologies and methods. These technologies and methods usually adopt glass, metal or conventional stable polymers as the substrates, while biomass materials with poor thermal stability are not suitable. Meanwhile, they are time-consuming, complicated in operation, high in cost and have other issues.

The low-temperature plasma-enhanced chemical vapor deposition of silicon oxide is flexible in operation and has good process repeatability. The prepared silicon oxide film has fewer impurities, high barrier properties, good transparency, and stable chemical properties. The coating can be controlled and modified accurately by changing the precursor and gas mixture. In particular, this method can meet the preparation requirements at lower temperatures and reduce the thermal damage to the materials, which is very important for the relatively temperature-sensitive cellulose substrate. Therefore, as an efficient, low-cost, clean and environmentally friendly surface modification method for super-hydrophobic materials, the deposition of silicon oxide by a low-temperature plasma-enhanced chemical vapor deposition method has a very broad application prospect.

SUMMARY

The present disclosure is to provide a method for preparing a cellulose-silicon oxide composite superhydrophobic material to solve the above-mentioned problems in the prior art. The preparation method of the cellulose-silicon oxide composite superhydrophobic material is simple for the operation, safe, efficient, and low in cost, and with this method, the hydrophobicity and barrier properties of the original cellulose substrate could be greatly improved.

In order to achieve at least the above object, the present disclosure provides at least the following technical solutions:

The present disclosure provides a method for preparing a cellulose-silicon oxide composite superhydrophobic material, comprising:

(1) preparing a cellulose substrate in the form of paper, paperboard or film;

(2) pretreating the cellulose substrate with a low-temperature plasma;

(3) depositing a first silicon oxide layer with a thickness of 200-1200 nm on the pretreated cellulose substrate by a low-temperature plasma-enhanced chemical vapor deposition method;

(4) after removing residual reactants in step (3), modifying the first silicon oxide layer initially deposited with a low-temperature plasma; and (5) depositing a second silicon oxide layer with a thickness of 40-160 nm on the modified first silicon oxide layer by a low-temperature plasma-enhanced chemical vapor deposition method, to finally obtain a micro-nano structured superhydrophobic surface.

In some embodiments, in step (1), the cellulose substrate is selected from the group consisting of a softwood cellulose substrate, a hardwood cellulose substrate, a bamboo cellulose substrate and a grass cellulose substrate.

In some embodiments, the softwood is selected from the group consisting of red pine, masson pine, spruce and metasequoia; the hardwood is selected from the group consisting of poplar, eucalyptus, and birch; the bamboo is selected from the group consisting of moso bamboo, *Neosinocalamus affinis*, and *Phyllostachys heteroclada* Oliver; the grass is selected from the group consisting of bagasse, straw, reed, corn stalk, and Musa basjoo Siebold stalk.

In some embodiments, in step (1), the cellulose substrate has a surface topography in the form of the smooth plane, or with corrugated, checkered or dot-matrix patterns.

In some embodiments, in step (1), the cellulose substrate has a grammage of 60-500 g/m2 for the form of paper and paperboard, and a grammage of 38-68 g/m2 for the form of film. The grammage for paper and paperboard is measured according to the international standard ISO 536:2012(E). The grammage for film is measured with a similar method as described in the international standard ISO 536:2012(E), in which paper and board are replaced with film.

For the preparation of the cellulose substrate, in some embodiments, a bleached pulp is used as a raw material to prepare a substrate in the form of paper and a film. The process is as follows:

a. Preparation of the substrate (in the form of paper and paperboard) with different surface topographies: fully moistening the bleached pulp and disconnecting, to prepare into a pulp with a concentration of 10%; beating the pulp by a PFI beater, and adding an additive if required during the process; weighing the obtained wet pulp after beating, making paper by Kaiser rapid prototyping equipment; and finally, for the paper substrate, after preliminary squeezing to dehydrate, sandwiching single piece of wet paper sheet between a carrier paperboard and a cloth of a certain specification to dry; for the paperboard substrate, stacking each piece of wet paper sheet together in the order as required, and respectively putting a carrier paperboard and a paper making felt on the two sides, then fully squeezing to dehydrate, drying and calendering; wherein the cloth is filter cloth or non-woven cloth with 180-300 mesh different textures (such as plain weave, twill weave, satin weave, square hole and concave-convex dot matrix, etc.), which may be used to obtain paper substrates with different single surface topographies after drying, as shown in (a), (b), and (c) in FIG. 1.

b. Preparation of a film substrate with different surface topographies: fully moistening the bleached pulp and disconnecting, to prepare into a pulp with a concentration of 2%-3%, and grinding the pulp by an ultrafine pulverizer for 6-10 times; then diluting the ground pulp to a concentration below 1% with water, and treating by a high-pressure homogenizer at a pressure of 1000-2000 bar absolute for 12-20 times, to obtain a cellulose nanofibers (CNFs) suspension; finally, suction filtering the CNFs suspension to form a film by using a sand core filter and a filter membrane according to the papermaking principle, and sandwiching the obtained film between a carrier paperboard and a cloth for dehydration and drying, to obtain a nanocellulose film with different single-surface topographies, as shown in (d) and (e) in FIG. 1.

In some embodiments, in step (2), a distance between the electrode plates is 2-6 cm during the process of pretreating the cellulose substrate with a low-temperature plasma.

In some embodiments, in step (2), a mixed gas of argon and oxygen, of argon and carbon dioxide, or of argon and air is used as a carrier gas; a volume ratio of argon to the other gas is 1:10 to 1:1; the total pressure in the deposition vacuum chamber is 15-30 Pa absolute, the power is 50-150 W, and the frequency is 40 kHz; the pretreatment is performed for 30-180 s.

In some embodiments, for the substrate, after pretreatment with a low-temperature plasma, the surface roughness decreases by 3%-10%, the carbon element content decreases, the oxygen element content increases, and the oxygen/carbon ratio increases. In some embodiments, the distance between the electrode plates is set to 3 cm, a mixed gas of argon and air with an argon/air volume ratio of 1:2 is used as the carrier gas, the total pressure in the deposition vacuum chamber is maintained at 25 Pa absolute and the power is 100 W; for the paper substrate, the pretreatment is performed for 90 s, while 60 s for the film substrate.

In some embodiments, in steps (3) and (5), in the low-temperature plasma-enhanced chemical vapor deposition method, the precursor used is selected from the group consisting of tetramethyldisiloxane, hexamethyldisiloxane, tetramethyldivinyl disiloxane, bis(tert-butylamino)silane, trimethyl(dimethylamino) silane, tetraethyl orthosilicate, diisopropylamino silane, bis(diethylamino)silane, octamethylcyclotetrasiloxane, decamethylcyclopentasiloxane, and dodecamethylcyclohexasiloxane; the oxidant used is oxygen; under the condition that the vacuum degree in the deposition vacuum chamber is 3 Pa absolute, the precursor is introduced first, and then oxygen is introduced, with a volume ratio of oxygen to the precursor of 1:1-1:8; the total pressure in the deposition vacuum chamber is 20-50 Pa absolute; the power is 50-150 W, and the frequency is 40 kHz; the deposition is performed for 1-20 min.

In some embodiments, after removing residues in the pretreatment, under the condition that the vacuum degree in the deposition vacuum chamber is 3 Pa absolute, the precursor is introduced first, and then oxygen is introduced, which is helpful for the growth of a uniform dense film with a low crack rate and a stable performance.

In some embodiments, in step (3), decamethylcyclopentasiloxane is used as the precursor; a volume ratio of oxygen to the precursor is 1:3; the total pressure in the deposition vacuum chamber is maintained at 20 Pa absolute, and the power is 100 W; the deposition is performed for 10 min for the paper substrate, while 7 min for the film substrate.

In some embodiments, in step (5), decamethylcyclopentasiloxane is used as the precursor; a volume ratio of oxygen to the precursor is 1:6; the total pressure in the deposition vacuum chamber is maintained at 20 Pa absolute, and the power is 100 W; the deposition is performed for 3.5 min for the paper substrate, while 2 min for the film substrate.

In some embodiments, in step (4), the precursor used in the low-temperature plasma is selected from the group consisting of tetrafluoromethane, a fluorosilane and a fluorosiloxane, and argon is used as an auxiliary gas.

In some embodiments, the fluorosilane may be for example difluorodimethylsilane, (trifluoromethyl)trimethylsilane and tridecafluorooctyltriethoxysilane. The fluorosiloxane may be for example trifluoropropylmethylcyclotrisiloxane.

In some embodiments, (trifluoromethyl)trimethylsilane is used as the precursor; the total pressure in the deposition vacuum chamber is maintained at 30 Pa absolute, and the power is 120 W; the modification is performed for 90 s.

In some embodiments, in step (4), under the condition that the vacuum degree in the deposition vacuum chamber is 3 Pa absolute, argon gas is introduced first until that the total pressure in the deposition vacuum chamber reaches 10 Pa absolute, and then the precursor is introduced; the total pressure in the deposition vacuum chamber is maintained at 20-50 Pa absolute, the power is 50-150 W, and the frequency is 40 kHz; the modification is performed for 30-150 s.

Some embodiments of the present disclosure has the following technical effects:

In the present disclosure, pure cellulose-based materials are made into cellulose substrates in different forms, and then the substrate is pretreated by a low-temperature plasma, thereby reducing the surface roughness of the cellulose substrate, and then a first silicon oxide layer is deposited by a low-temperature plasma enhanced chemical vapor method; after modifying the first silicon oxide layer, a second silicon oxide layer is deposited thereon, and finally a micro-nano structured superhydrophobic surface is formed on the cellulose surface. In the present disclosure, on the basis of the clean low-temperature plasma-enhanced chemical vapor deposition method, a micro-nano structure superhydrophobic surface is formed on a cellulose substrate, which is hydrophilic, sensitive to temperature, and easy to be broken down by high voltage and thereby damaged, and has poor thermal stability, obtaining an environmentally friendly bio-based hydrophobic material. The cellulose-silicon oxide composite superhydrophobic material exhibits a superhydrophobic performance in water at 4-80° C., with a static water contact angle greater than 150°, and a water sliding angle less than 6°. Compared with glass, metal and plastic substrates with good stability, as well as preparation methods of superhydrophobic materials such as lithography, chemical synthesis assembly or nanoimprinting, etc., which are complicated in operation, and uses more poisonous reagents, or more expensive equipment, the method according to present disclosure is simple in process, safe and efficient, and low in cost, and the product prepared by the same is stable in performance, and thus it can be widely used in packaging, tableware, antifouling and other fields.

BRIEF DESCRIPTION OF THE DRAWINGS

In order to illustrate the embodiments of the present disclosure or the technical solutions in the prior art more clearly, the following will briefly introduce the drawings needed in the embodiments. Obviously, the drawings described below are only some embodiments of the present disclosure. For those ordinary skilled in the art, without creative labor, other drawings may be obtained from these drawings.

DETAILED DESCRIPTION

Various embodiments of the present disclosure are described in detail. The detailed description should not be considered as a limitation to the present disclosure, but should be understood as a more detailed description of certain aspects, characteristics, and embodiments of the present disclosure.

It should be understood that the terms described in the present disclosure are only used to describe specific embodiments and are not used to limit the scope of the present disclosure. In addition, for the numerical range in the present disclosure, it should be understood that each intermediate value between the upper limit and the lower limit of the range is also specifically disclosed. Each smaller range between any stated value or intermediate value within the stated range and any other stated value or intermediate value within the stated range is also covered in the present disclosure. The upper and lower limits of these smaller ranges can be independently included within the range or eliminated out of the range.

Unless otherwise specified, all technical and scientific terms used herein have the same meaning as commonly understood by those ordinary skilled in the art. Although the present disclosure only describes preferred methods and materials, any methods and materials similar or equivalent to those described herein can also be used in the practice or testing of the present disclosure. All references mentioned in this specification are incorporated by reference to disclose and describe methods and/or materials related to the references. In the event of conflicting with any incorporated references, the content of this text shall prevail.

Without departing from the scope or spirit of the present disclosure, various improvements and changes can be made to the specific embodiments of the present specification, which is obvious to those skilled in the art. Other embodiments derived from the specification of the present disclosure will be obvious to the skilled person. The specification and examples of this disclosure are only exemplary.

As used herein, "comprising", "including", "having", "containing", etc., are all open terms, which means including but not limited to.

Example 1

Figure 1:
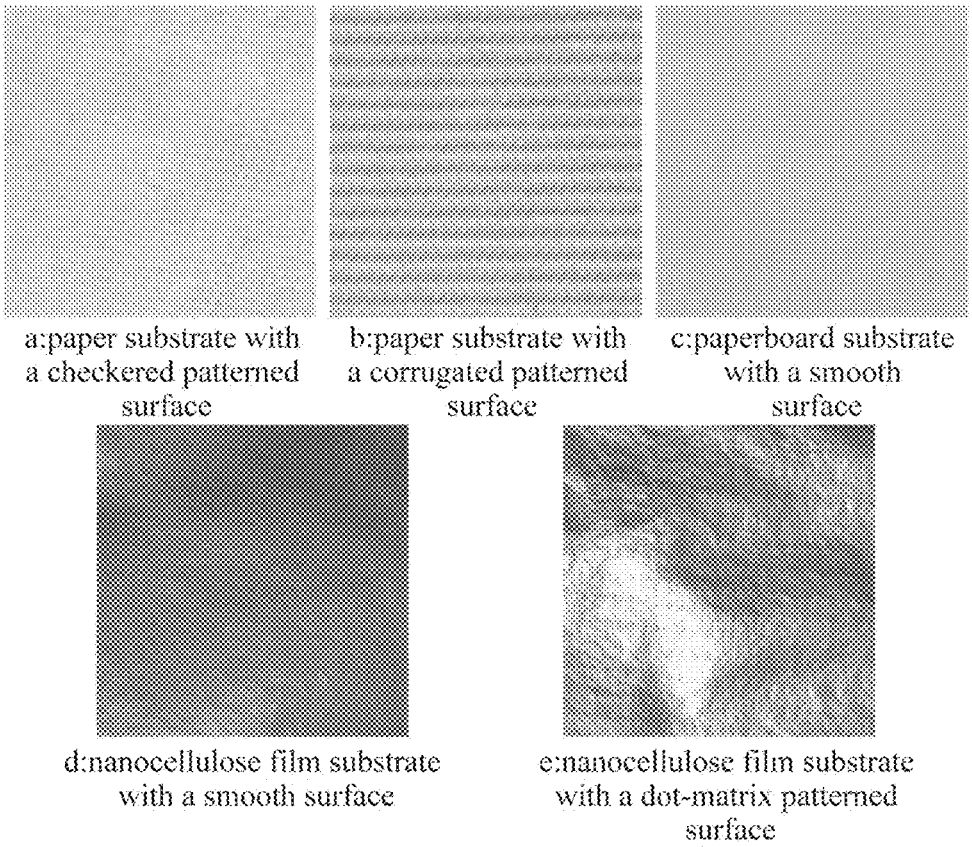
FIG. 1 shows substrates with different surface topographies; in which (a) shows the paper substrate with a checkered patterned surface in Example 1, (b) shows the paper substrate with a corrugated patterned surface in Example 2, (c) shows the paperboard substrate with a smooth surface in Example 3, (d) shows the nanocellulose film substrate with a smooth surface in Example 4, and (e) shows the nanocellulose film substrate with a dot-matrix patterned surface in Example 5.

(1) Preparation of a paper substrate with a checkered patterned surface topography: the bleached spruce pulp was fully moistened, then disconnected to prepare into a pulp with a concentration of 10%, and the pulp was beaten by a PFI beater; then the obtained wet pulp after beating was weighed, to make paper by a Kaiser rapid prototyping equipment; after squeezing to dehydrate, finally a single piece of wet paper sheet was sandwiched between a smooth carrier paperboard and a cloth with 300-mesh textures to dry, obtaining paper with a single checkered patterned surface and a grammage of 60 g/m$^2$, as shown in (a) in FIG. 1.

(2) Under the condition that the distance between the electrode plates was 2 cm, the paper substrate was pretreated with a low-temperature plasma, in which a mixed gas of argon and oxygen with an argon/oxygen volume ratio of 1:3 was used as the carrier gas, under the conditions that the total pressure in the deposition vacuum chamber was maintained at 15 Pa absolute, the power was 50 W, and the frequency was 40 kHz, the pretreatment was performed for 180 s.

(3) The deposition of a first silicon oxide layer on the pretreated paper substrate by a low-temperature plasma-enhanced chemical vapor deposition method: tetramethyldivinyldisiloxane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:1; under the conditions that the total pressure in the deposition vacuum chamber was maintained at 20 Pa absolute, the power was 50 W and the frequency was 40 kHz, the deposition was performed for 5 min.

(4) After removing residual reactants in the previous step, the modification of the first silicon oxide layer deposited above by a low-temperature plasma: difluorodimethylsilane was used as the precursor and argon was used as the auxiliary gas; under the condition that the vacuum degree in the deposition vacuum chamber was 3 Pa absolute, argon was introduced first until that the total pressure in the deposition vacuum chamber reached 10 Pa absolute, then the precursor was introduced; under the conditions that the total pressure in the deposition vacuum chamber was maintained at 30 Pa absolute, the power was 100 W, and the frequency was 40 kHz, the modification was performed for 90 s.

(5) The deposition of a second silicon oxide layer on the modified silicon oxide layer above by a low-temperature plasma-enhanced chemical vapor deposition method: tetramethyldivinyldisiloxane was used as the precursor and oxygen was used as the oxidant; after removing residues in the pretreatment, under the condition that the vacuum degree in the deposition vacuum chamber was 3 Pa absolute, the precursor was introduced first and then oxygen was introduced, with a volume ratio of oxygen to the precursor of 1:3; under the conditions that the total pressure in the deposition vacuum chamber was maintained at 20 Pa absolute, the power was 50 W and the frequency was 40 kHz, the deposition was performed for 3 min.

Figure 2:
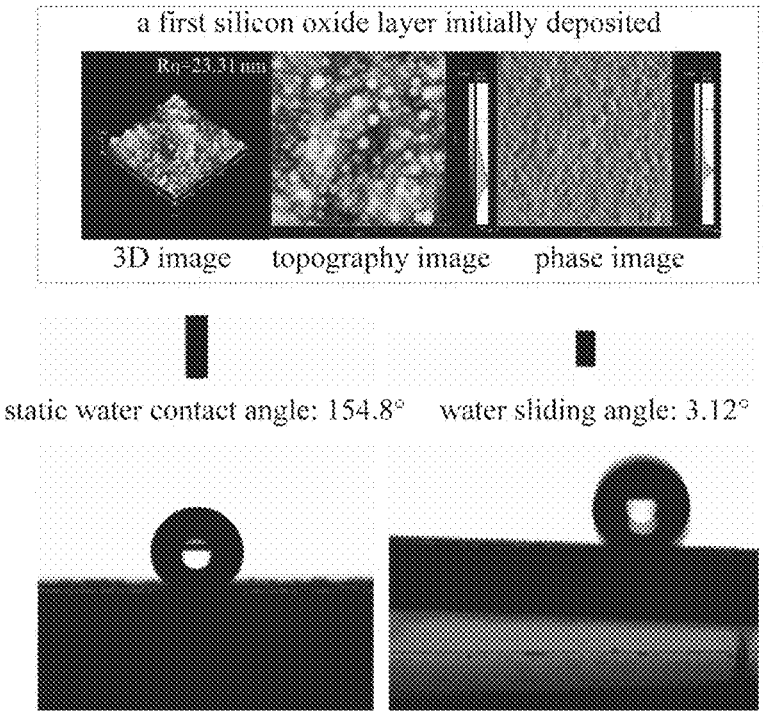
FIG. 2 shows an AFM image of the first silicon oxide layer deposited initially during the preparation process of the composite material in Example 1, and a static water contact angle diagram and a water sliding angle diagram of the prepared superhydrophobic composite material in water at 4° C.

As a result, for the paper substrate, after pretreatment, the surface roughness decreased by 9%, the carbon element content decreased, oxygen element content increased, the oxygen/carbon ratio increased, the static water contact angle was 98.5°, and the water sliding angle was >45°. The first silicon oxide layer initially deposited had a thickness of 200 nm, a surface roughness of 23.31 nm, a static water contact angle of 131.4°, and a water sliding angle of 19.26°; the second silicon oxide layer deposited again had a thickness of 114 nm, and a surface roughness of 46.64 nm. The finally prepared paper-silicon oxide composite superhydrophobic material was superhydrophobic in water at 4° C., with a static water contact angle of 154.8° and a water sliding angle of 3.12°, as shown in FIG. 2.

Example 2

(1) Preparation of a paper substrate with a corrugated patterned surface topography: the bleached poplar pulp was fully moistened and disconnected to prepare into a pulp with a concentration of 10%, and the obtained pulp was beaten by PFI beater; the obtained wet pulp after beating was weighed, to make paper by a Kaiser rapid prototyping equipment; after squeezing to dehydrate, finally a single piece of wet paper sheet was sandwiched between a smooth carrier paperboard and a cloth with 180-mesh textures to dry, obtaining paper with a single corrugated patterned surface and a grammage of 160 g/m$^2$, as shown in (b) in FIG. 1.

(2) Under the condition that the distance between the electrode plates was 4 cm, the paper substrate was pretreated with a low-temperature plasma, in which a mixed gas of argon and oxygen with an argon/oxygen volume ratio of 1:1 was used as the carrier gas; under the conditions that the total pressure in the deposition vacuum chamber was maintained at 20 Pa absolute, the power was 100 W, and the frequency was 40 kHz, the pretreatment was performed for 30 s.

(3) The deposition of a first silicon oxide layer on the pretreated paper substrate by a low-temperature plasma-enhanced chemical vapor deposition method: bis(tert-butylamino)silane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:2; under the conditions that the total pressure in the deposition vacuum chamber was maintained at 35 Pa absolute, the power was 100 W, and the frequency was 40 kHz, the deposition was performed for 10 min.

(4) After removing residual reactants in the previous step, the modification of the first silicon oxide layer deposited above by a low-temperature plasma: tetrafluoromethane was used as the precursor and argon was used as the auxiliary gas; under the condition that the vacuum degree in the deposition vacuum chamber was 3 Pa absolute, argon was first introduced until that the total pressure in the deposition vacuum chamber reached 10 Pa absolute, and then the precursor was introduced; under the conditions that the total pressure in the deposition vacuum chamber was maintained at 20 Pa absolute, the power was 50 W, and the frequency was 40 kHz, the modification was performed for 120 s.

(5) The deposition of a second silicon oxide layer on the modified first silicon oxide layer above by a low-temperature plasma-enhanced chemical vapor deposition method: bis(tert-butylamino)silane was used as the precursor and oxygen was used as the oxidant; after removing residues in the pretreatment, under the condition that the vacuum degree in the deposition vacuum chamber was 3 Pa absolute, the precursor was introduced first and then oxygen was introduced, with a volume ratio of oxygen to the precursor of 1:8; under the conditions that the total pressure in the deposition vacuum chamber was maintained at 50 Pa absolute, the power was 150 W and the frequency was 40 kHz, the deposition was performed for 4 min.

Figure 3:
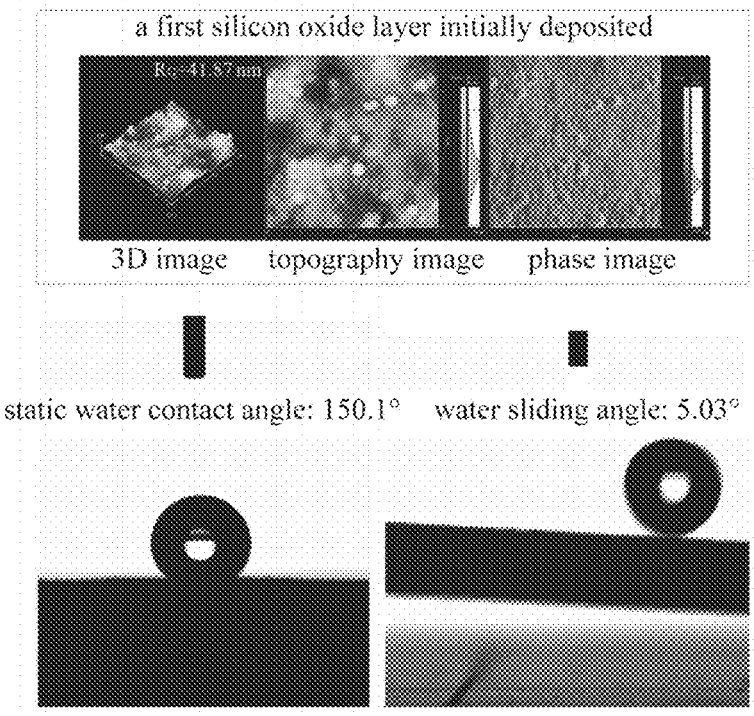
FIG. 3 shows an AFM image of the first silicon oxide layer deposited initially during the preparation process of the composite material in Example 2, and a static water contact angle diagram and a water sliding angle diagram of the prepared superhydrophobic composite material in water at 80° C.

As a result, for the paper substrate, after pretreatment, the surface roughness decreased by 3%, the carbon element content decreased, the oxygen element content increased, the oxygen/carbon ratio increased, the static water contact angle was 87.8°, and the water sliding angle was >45°. The first silicon oxide layer initially deposited had a thickness of 520 nm, a surface roughness of 41.87 nm, a static water contact angle of 121.3°, and a water sliding angle of 30.45°; the second silicon oxide layer deposited again has a thickness of 160 nm, and a surface roughness of 60.65 nm. The finally prepared paper-silicon oxide composite superhydrophobic material was superhydrophobic in water at 80° C., with a static water contact angle of 150.1° and a water sliding angle of 5.03°, as shown in FIG. 3.

Example 3

A method for preparing a superhydrophobic material from cellulose and silicon oxide, comprising the following steps:

(1) preparation of a paper substrate with a smooth surface: the bleached eucalyptus pulp was fully moistened and disconnected, to prepare into a pulp with a concentration of 10%, and the obtained pulp was beaten by a PFI beater; then the obtained wet pulp after beating was weighed, to make paper by a Kaiser rapid prototyping equipment; finally, each piece of wet paper sheet was stacked together in the order as required, and a carrier paperboard and a blanket were put respectively on the two sides to sandwich the stacking of the wet paper sheet, then fully squeezed to dehydrate, dried and calendered, obtaining a paperboard with a smooth surface and a grammage of 500 g/m$^2$, as shown in (c) in FIG. 1;

(2) under the condition that the distance between the electrode plates was 6 cm, the paperboard substrate was pretreated with a low-temperature plasma, in which a mixed gas of argon and air with an argon/air volume ratio of 1:2 was used as the carrier gas; under the conditions that the total pressure in the deposition vacuum chamber was maintained at 15 Pa absolute, the power was 50 W, and the frequency was 40 kHz, the pretreatment was performed for 90 s;

(3) the deposition of a first silicon oxide layer on the pretreated paperboard by a low-temperature plasma-enhanced chemical vapor deposition method: decamethylcyclopentasiloxane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:2; under the conditions that the total pressure in the deposition vacuum chamber was maintained at 25 Pa absolute, the power was 80 W, and the frequency was 40 kHz, the deposition was performed for 20 min;

(4) after removing the residual reactants in the previous step, the modification of the first silicon oxide layer deposited above by a low-temperature plasma: (trifluoromethyl) trimethylsilane was used as the precursor and argon was used as the auxiliary gas; under the condition that the vacuum degree in the deposition vacuum chamber was 3 Pa absolute, argon was introduced first until that the total pressure in the deposition vacuum chamber reached 10 Pa absolute, and then the precursor was introduced; under the conditions that the total pressure in the deposition vacuum chamber was maintained at 40 Pa absolute, the power was 120 W, and the frequency was 40 kHz, the modification was performed for 150 s;

(5) the deposition of a second silicon oxide layer on the modified first silicon oxide layer above by a low-temperature plasma-enhanced chemical vapor deposition method: decamethylcyclopentasiloxane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:4; under the conditions that the total pressure in the deposition vacuum chamber was maintained at 35 Pa absolute, the power was 120 W, and the frequency was 40 kHz, the deposition was performed for 4 min.

Figure 4:
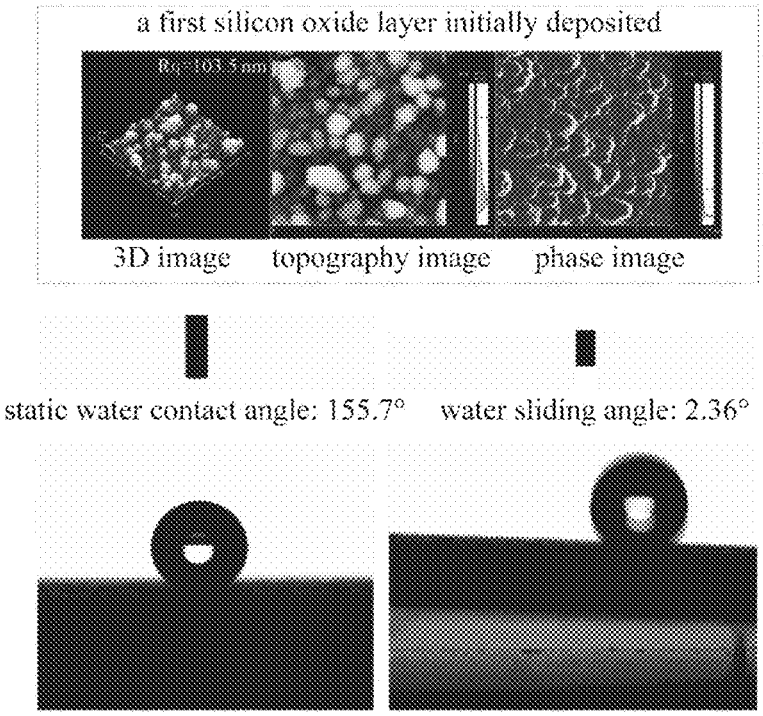
FIG. 4 shows an AFM image of the first silicon oxide layer deposited initially during the preparation process of the composite material in Example 3, and a static water contact angle diagram and a water sliding angle diagram of the prepared superhydrophobic composite material in water at 60° C.

As a result, for the paperboard substrate, after pretreatment, the surface roughness decreased by 10%, the carbon element content decreased, the oxygen element content increased, the oxygen/carbon ratio increased, the static water contact angle was 106.2°, and the water sliding angle was >45°. The first silicon oxide layer initially deposited had a thickness of 1200 nm, a surface roughness of 103.5 nm, a static water contact angle of 139.6°, and a water sliding angle of 17.53°; the second silicon oxide layer deposited again had a thickness of 140 nm, and a surface roughness of 132.03 nm. The finally prepared paperboard-silicon oxide composite superhydrophobic material was superhydrophobic in water at 60° C., with a static water contact angle of 155.7°, and a water sliding angle of 2.36°, as shown in FIG. 4.

Example 4

A method for preparing a superhydrophobic material from cellulose and silicon oxide, comprising the following steps:

(1) preparation of a film substrate with a smooth surface: the bleached bagasse pulp was fully moistened and disconnected to prepare into a pulp with a concentration of 3%, and then ground for 10 times by an ultrafine pulverizer; then the ground pulp was diluted with water to a concentration of 0.8%, and treated by a high-pressure homogenizer at a pressure of 2000 bar absolute for 20 times, obtaining a cellulose nanofibers (CNFs) suspension; finally, according to the papermaking principle, the CNFs suspension was suction filtered to form a film by using a sand core filter and a filter membrane, and the film obtained was sandwiched between the smooth paperboard to dehydrate and dry, obtaining a nanocellulose film with a smooth surface and a grammage of 38 g/m$^2$, as shown in (d) in FIG. 1;

(2) under the condition that the distance between the electrode plates was 3 cm, the nanocellulose film substrate was pretreated by a low-temperature plasma, in which the mixed gas of argon and carbon dioxide with an argon/carbon dioxide volume ratio of 1:4 was used as the carrier gas; under the conditions that the total pressure in the deposition vacuum chamber was maintained at 25 Pa absolute, the power was 100 W, and the frequency was 40 kHz, the pretreatment was performed for 90 s;

(3) the deposition of a first silicon oxide layer on the pretreated nanocellulose film by a low-temperature plasma-enhanced chemical vapor deposition method: octamethylcyclotetrasiloxane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:3; under the conditions that the total pressure in the deposition vacuum chamber was maintained at 30 Pa absolute, the power was 100 W, and the frequency was 40 kHz, the deposition was performed for 9 min;

(4) after removing residual reactants in the previous step, the modification of the first silicon oxide layer deposited above by a low-temperature plasma: trifluoropropylmethylcyclotrisiloxane was used as the precursor and argon was used as the auxiliary gas; under the condition that the vacuum degree in the deposition vacuum chamber was 3 Pa absolute, argon was introduced first until that the total pressure in the deposition vacuum chamber reached 10 Pa absolute, and then the precursor was introduced; under the condition that the total pressure in the deposition vacuum chamber was maintained at 35 Pa absolute, the power was 110 W, and the frequency was 40 kHz, the modification was performed for 120 s;

(5) the deposition of a second silicon oxide layer on the modified first silicon oxide layer above by a low-temperature plasma-enhanced chemical vapor deposition method: octamethylcyclotetrasiloxane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:6; under the conditions that the total pressure in the deposition vacuum chamber was maintained at 45 Pa absolute, the power was 120 W, and the frequency was 40 kHz, the deposition was performed for 1 min.

Figure 5:
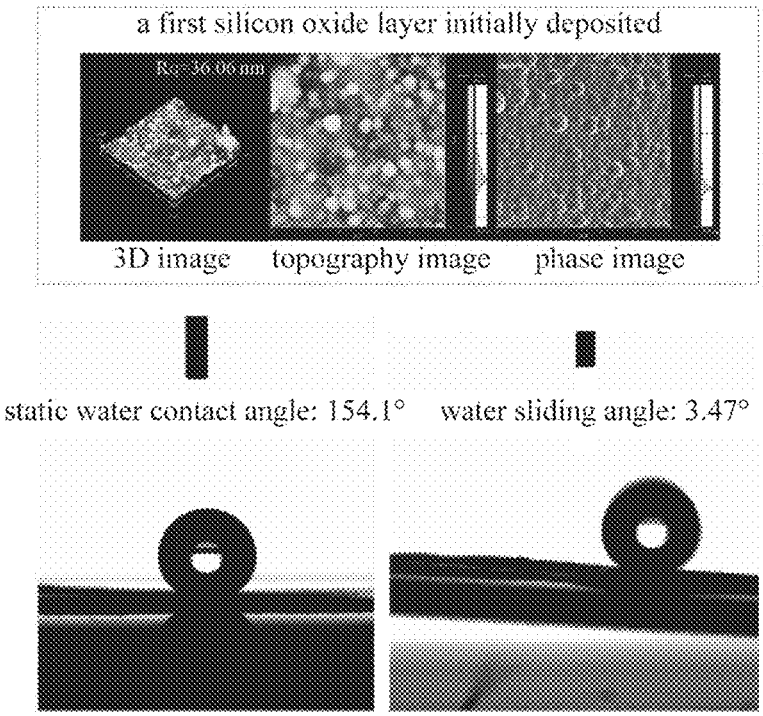
FIG. 5 shows an AFM image of the first silicon oxide layer deposited initially during the preparation process of the composite material in Example 4, and a static water contact angle diagram and a water sliding angle diagram of the prepared superhydrophobic composite material in water at 40° C.

As a result, for the nanocellulose film substrate, after the pretreatment, the surface roughness decreased by 7%, the carbon element content decreased, the oxygen element content increased, the oxygen/carbon ratio increased, the static water contact angle was 74.3°, and the water sliding angle was >45°. The first silicon oxide layer initially deposited had a thickness of 460 nm, a surface roughness of 36.06 nm, a static water contact angle of 130.3°, and a water sliding angle of 22.61°; the second silicon oxide layer deposited again had a thickness of 40 nm, and a surface roughness of 48.87 nm. The finally prepared nanocellulose film-silicon oxide composite superhydrophobic material was superhydrophobic in water at 40° C., with a static water contact angle of 154.1° and a water sliding angle of 3.47°, as shown in FIG. 5.

Example 5

A method for preparing a superhydrophobic material from cellulose and silicon oxide, comprising the following steps:

(1) preparation of a film substrate with a dot-matrix patterned surface topography: the bleached bagasse pulp was fully moistened and disconnected to prepare into a pulp with a concentration of 2%, then ground by an ultrafine pulverizer for 6 times; then ground pulp was diluted with water to a concentration of 0.5%, and then treated by a high-pressure homogenizer at a pressure of 1000 bar for 10 times, obtaining a cellulose nanofibers (CNFs) suspension; finally, according to the papermaking principle, the CNFs suspension was suction filtered to form a film by using a sand core filter and a filter membrane, and the film obtained was sandwiched between the smooth paperboard and the cloth to dehydrate and dry, obtaining a nanocellulose film with a single dot-matrix patterned surface and a grammage of 68 g/m$^2$, as shown in (e) in FIG. 1;

(2) under the condition that the distance between the electrode plates was 5 cm, the nanocellulose film substrate was pretreated by a low-temperature plasma, in which the mixed gas of argon and air with an argon/air volume ratio of 1:10 was used as the carrier gas; under the conditions that the total pressure in the deposition vacuum chamber was maintained at 30 Pa absolute, the power was 150 W, and the frequency was 40 kHz, the modification was performed for 60 s;

(3) the deposition of a first silicon oxide layer on the pretreated nanocellulose film by a low-temperature plasma-enhanced chemical vapor deposition method: hexamethyldisiloxane was used as the precursor and oxygen was used as the oxidant; after removing residues in the pretreatment, under the condition that the vacuum degree in the deposition vacuum chamber was 5 Pa absolute, the precursor was introduced first, and then oxygen was introduced, with a volume ratio of oxygen to the precursor of 1:6; under the conditions that the total pressure in the deposition vacuum chamber was maintained at 45 Pa absolute, the power was 150 W, and the frequency was 40 kHz, the deposition was performed for 7 min;

(4) after removing residual reactants in the previous step, the modification of the first silicon oxide layer deposited above by a low-temperature plasma: tridecafluorooctyltriethoxysilane was used as the precursor and argon was used as the auxiliary gas; under the condition that the vacuum degree in the deposition vacuum chamber was 3 Pa absolute, argon was introduced first until that the total pressure in the deposition vacuum chamber reached 10 Pa absolute, and then the precursor was introduced; under the conditions that the total pressure in the deposition vacuum chamber was maintained at 50 Pa absolute, the power was 150 W, and the frequency was 40 kHz, the modification was performed for 30 s;

(5) the deposition of a second silicon oxide layer on the modified first silicon oxide layer above by a low-temperature plasma-enhanced chemical vapor deposition method: hexamethyldisiloxane was used as the precursor and oxygen was used as the oxidant; after removing residues in the pretreatment, under the condition that the vacuum degree in the deposition vacuum chamber was 3 Pa absolute, the precursor was introduced first, and then oxygen was introduced, with a volume ratio of oxygen to the precursor of 1:8. Under the conditions that the total pressure in the deposition vacuum chamber was maintained at 50 Pa absolute, the power was 150 W, and the frequency was 40 kHz, the deposition was performed for 2 min.

Figure 6:
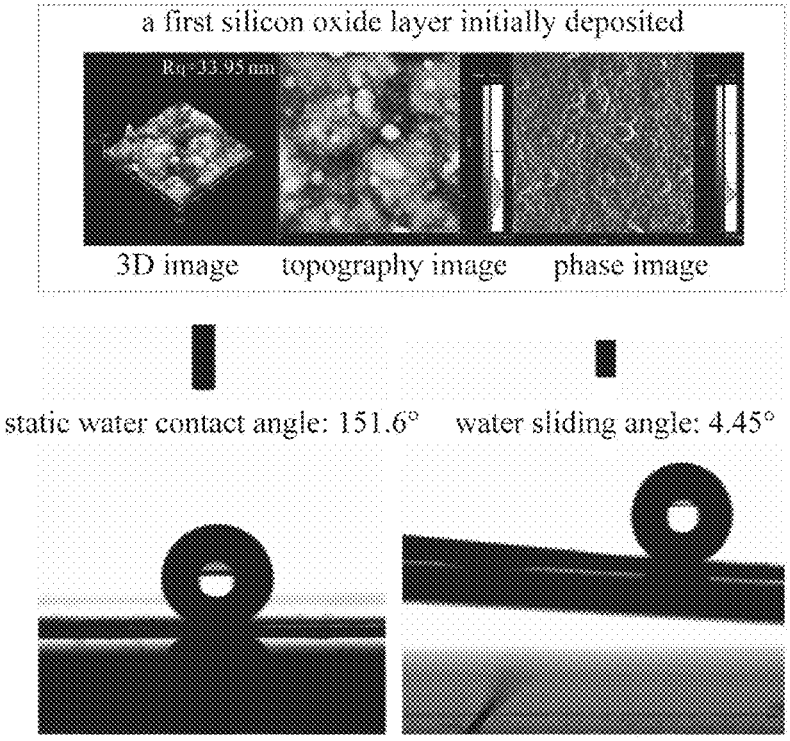
FIG. 6 shows an AFM image of the first silicon oxide layer deposited initially during the preparation process of the composite material in Example 5, and a static water contact angle diagram and a water sliding angle diagram of the prepared superhydrophobic composite material in water at 20° C.

As a result, for the nanocellulose film substrate, after pretreatment, the surface roughness decreased by 6%, the carbon content decreased, the oxygen content increased, the oxygen/carbon ratio increased, the static water contact angle was 68.7°, and the water sliding angle was >45°. The first silicon oxide layer deposited initially had a thickness of 350 nm, a surface roughness of 33.95 nm, a static water contact angle of 127.4°, and a water sliding angle of 27.04°; the second silicon oxide layer deposited again had a thickness of 86 nm, and a surface roughness of 52.56 nm. The finally prepared nanocellulose film-silicon oxide composite superhydrophobic material was superhydrophobic in water at 20° C., with a static water contact angle of 151.6° and a water sliding angle of 4.45°, as shown in FIG. 6.

The low-temperature plasma method of the present disclosure was a method that uses a low-temperature plasma equipment to perform the vapor-phase chemical deposition, pretreatment or modification, and its specific operation steps are the prior art known in the art, and will not be repeated here.

The above-mentioned embodiments only describe the preferred mode of the present disclosure, and do not limit the scope of the present disclosure. Without departing from the spirits of the present disclosure, variations and improvements to the technical solutions of the present disclosure made by those ordinary skilled in the art shall fall within the scope defined in the claims of the present disclosure.

What is claimed is:

1. A method for preparing a cellulose-silicon oxide composite superhydrophobic material, comprising:

preparing a cellulose substrate in the form of paper, paperboard or a film;

pretreating the cellulose substrate with a low-temperature plasma;

depositing a first silicon oxide layer with a thickness of 200-1200 nm on the pretreated cellulose substrate by a low-temperature plasma-enhanced chemical vapor deposition method;

after removing residual reactants in the depositing, modifying the first silicon oxide layer initially deposited with a low-temperature plasma; and depositing a second silicon oxide layer with a thickness of 40-160 nm on the modified first silicon oxide layer by a low-temperature plasma-enhanced chemical vapor deposition method, to finally obtain a micro-nano structured superhydrophobic surface, wherein in the pretreating, a mixed gas of argon and oxygen, argon and carbon dioxide, or argon and air is used as a carrier gas, wherein the argon accounts for 1/11-1/2 of the total gas volume, the total pressure in the deposition vacuum chamber is 15-30 Pa absolute, the power is 50-150 W, and the frequency is 40 kHz; the pretreatment is performed for 30-180 s.

2. The method for preparing a cellulose-silicon oxide composite superhydrophobic material as claimed in claim 1, wherein in the preparing, the cellulose substrate has a surface topography in the form of the smooth plane, or with corrugated, checkered or dot-matrix patterns.

3. The method for preparing a cellulose-silicon oxide composite superhydrophobic material as claimed in claim 1, wherein in the preparing, the cellulose substrate has a grammage of 60-500 g/m$^2$ for the form of paper and paperboard, and a grammage of 38-68 g/m$^2$ for the form of film.

4. The method for preparing a cellulose-silicon oxide composite superhydrophobic material as claimed in claim 1, wherein in the pretreating, the distance between the electrode plates is 2-6 cm during the process of pretreating the cellulose substrate by a low-temperature plasma.

5. A method for preparing a cellulose-silicon oxide composite superhydrophobic material, comprising:

preparing a cellulose substrate in the form of paper, paperboard or a film;

pretreating the cellulose substrate with a low-temperature plasma;

depositing a first silicon oxide layer with a thickness of 200-1200 nm on the pretreated cellulose substrate by a low-temperature plasma-enhanced chemical vapor deposition method;

after removing residual reactants in the depositing, modifying the first silicon oxide layer initially deposited with a low-temperature plasma; and depositing a second silicon oxide layer with a thickness of 40-160 nm on the modified first silicon oxide layer by a low-temperature plasma-enhanced chemical vapor deposition method, to finally obtain a micro-nano structured superhydrophobic surface, wherein in the depositing of the first silicon oxide layer and the depositing of the second silicon oxide layer, in the low-temperature plasma-enhanced chemical vapor deposition method, a precursor used is selected from the group consisting of tetramethyldisiloxane, hexamethyldisiloxane, tetramethyldivinyl disiloxane, bis(tert-butylamino)silane, trimethyl(dimethylamino)silane, tetraethyl ortho silicate, diisopropylamino silane, bis(diethylamino)silane, octamethylcyclotetrasiloxane, decamethylcyclopentasiloxane and dodecamethylcyclohexasiloxane, and the oxidant used is oxygen; under the condition that the vacuum degree in the deposition vacuum chamber is 3 Pa absolute, the precursor is introduced first, and then oxygen is introduced, with a volume ratio of oxygen to the precursor of 1:1 to 1:8; the total pressure in the deposition vacuum chamber is 20-50 Pa absolute, the power is 50-150 W, and the frequency is 40 kHz; the deposition is performed for 1-20 min.

6. A method for preparing a cellulose-silicon oxide composite superhydrophobic material, comprising:

preparing a cellulose substrate in the form of paper, paperboard or a film;

pretreating the cellulose substrate with a low-temperature plasma;

depositing a first silicon oxide layer with a thickness of 200-1200 nm on the pretreated cellulose substrate by a low-temperature plasma-enhanced chemical vapor deposition method;

after removing residual reactants in the depositing, modifying the first silicon oxide layer initially deposited with a low-temperature plasma; and depositing a second silicon oxide layer with a thickness of 40-160 nm on the modified first silicon oxide layer by a low-temperature plasma-enhanced chemical vapor deposition method, to finally obtain a micro-nano structured superhydrophobic surface, wherein a precursor used in the low-temperature plasma in the modifying is selected from the group consisting of tetrafluoromethane, a fluorosilane and a fluorosiloxane, and argon is used as an auxiliary gas; under the condition that the vacuum degree in the deposition vacuum chamber is 3 Pa absolute, argon is first introduced until that the total pressure in the deposition vacuum chamber reaches 10 Pa absolute, and then the precursor is introduced; the total pressure in the deposition vacuum chamber is 20-50 Pa absolute, the power is 50-150 W, and the frequency is 40 kHz; the modification is performed for 30-150 s.

* * * * *